United States Patent [19]

Karashima

[11] 4,139,247

[45] Feb. 13, 1979

[54] GOODS SHOWCASE

[76] Inventor: Masashi Karashima, 2-40-7, Sangenjaya, Setagaya-Ku, Tokyo, Japan

[21] Appl. No.: 849,513

[22] Filed: Nov. 7, 1977

[30] Foreign Application Priority Data

Oct. 18, 1977 [JP] Japan ..... 52-124115

[51] Int. Cl.[2] ..... A47F 3/06

[52] U.S. Cl. ..... 312/130; 312/301; 211/187; 108/137

[58] Field of Search ..... 312/130, 301; 211/186, 211/187, 193; 248/50; 108/108, 109, 137

[56] References Cited

U.S. PATENT DOCUMENTS

| | | | |
|---|---|---|---|
| 905,737 | 12/1908 | McCombe | 108/137 |
| 2,101,686 | 12/1937 | Offutt | 108/137 |
| 2,729,314 | 1/1956 | Doran | 211/187 |
| 2,790,559 | 4/1957 | Stephenson et al. | 108/108 |
| 3,057,483 | 10/1962 | Derman | 248/250 |
| 3,358,847 | 12/1967 | Magnuson | 211/186 |
| 3,556,306 | 1/1971 | Shell | 211/187 |
| 3,565,020 | 2/1971 | Schier | 211/186 |
| 3,587,867 | 6/1971 | Fenwick | 211/187 |
| 3,601,256 | 8/1971 | Bowers, Jr. | 211/193 |
| 3,640,389 | 2/1972 | Snyder | 211/187 |

*Primary Examiner*—Victor N. Sakran

*Attorney, Agent, or Firm*—Wenderoth, Lind & Ponack

[57] ABSTRACT

A goods showcase capable of arbitrarily varying depths of respective shelves is herein described. The shelf has struts with a plurality of engaging holes provided on their sides as aligned in columns, and shelf support members which each have a horizontal shelf plate support flange extending from a lower edge of a laterally long L-shaped vertical side plate provided with engaging pieces to be engaged in the engaging holes in the shelf strut and also have a plurality of engaging vertical claws erected from a free edge of the horizontal flange at a predetermined interval. The shelf plates each have a reinforcement crosspiece disposed in the widthwise direction on its back surface, and this crosspiece is provided with an engaging section to which is engage and disengage the engaging claws.

4 Claims, 14 Drawing Figures

GOODS SHOWCASE

BACKGROUND AND SUMMARY OF THE INVENTION

The present invention relates to improvements in a goods showcase adapted to be equipped, for example, in a supermarket.

Heretofore, in this type of showcase, the shelves were fixed at predetermined positions, so that it was impossible to increase the amount of goods displayed on the shelves.

The present invention was proposed in view of the aforementioned circumstance, and one object of the invention is to provide an improved goods showcase in which the amount of goods displayed on the shelves can be varied by shifting the shelf plates forwardly.

Another object of the present invention is to provide an improved goods showcase in which the amount of goods displayed on the shelves can be adjusted by adjusting the extent of forward shift of the shelf plates.

Still another object of the present invention is to provide an improved goods showcase in which goods can be easily loaded and unloaded on the shelf plates sideways of the shelves.

The goods showcase according to the present invention has been proposed to achieve the above-mentioned various objects, and it is characterized in that it comprises shelf struts having a plurality of engaging holes provided on their sides as aligned in columns, and shelf support members each having a horizontal shelf plate support flange extended from a lower edge of a laterally long L-shaped vertical side plate provided with engaging pieces to be engaged with the engaging holes in said shelf strut and also having a plurality of engaging vertical claws erected from a free edge of the horizontal flange at a predetermined interval. Shelf plates are provided which each have a reinforcement crosspiece disposed in the widthwise direction on its back surface, and this crosspiece is provided with an engaging section to be engaged with and disengaged from said engaging claws.

BRIEF DESCRIPTION OF THE DRAWINGS

Now the present invention will be described in connection to its preferred embodiments illustrated in the accompanying drawings, in which.

DETAILED DESCRIPTION OF THE INVENTION

Figure 2:
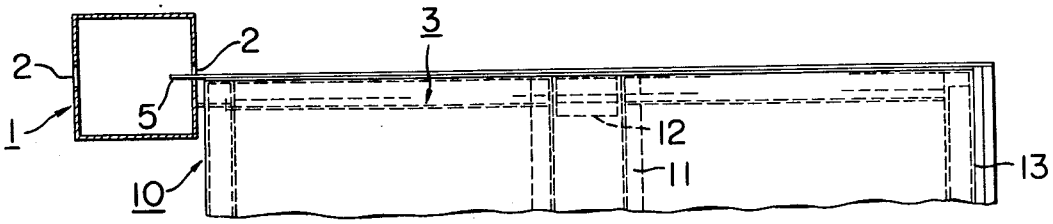
FIGS. 2 and 3 are a partial plan view and a longitudinal cross-section side view, respectively, showing the goods showcase according to the present invention in a normal state.

Referring now to the drawings, reference numeral (1) designates a shelf strut consisting of a hollow post having a rectangular cross-section. This strut has engaging holes (2) on its one side aligned in a vertical column at a predetermined intervals.

A shelf plate support member, having a laterally long L-shaped vertical side plate (4) consists of a horizontal section (4*a*) extending over a length of ⅔ or more of the overall length and a vertical section (4*b*) which extends from the rear of the horizontal, section. At the rear of the vertical section (4*b*) are engaging pieces (5) which engage and disengage the engaging holes (2). A flange (6) extends from the lower edge of the side plate (4) at right angles thereto, and vertical engaging claws (7) are erected at predetermined intervals from a middle portion of the horizontal flange (6) for supporting a shelf plate, the flange 6 extending from the horizontal section (4*a*). Also, flange 8 extends from the vertical section (4*b*), and upright pieces 9 extend from the respective flanges (6) and (8) except for the portion where the engaging claws (7) are provided.

Reference numeral (10) designates a shelf plate, and at the opposite side end portions of a channel-shaped reinforcement crosspiece (11), disposed in the widthwise direction on the back surface of the shelf plate, are notches (12) adapted to engage and disengage the engaging claws (7).

Figure 6:
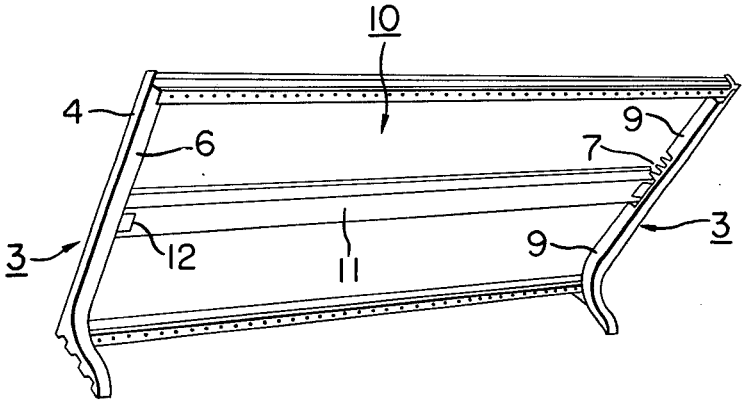
FIGS. 6 and 7 are perspective views showing states of a shelf plate as supported by a shelf plate support member in a normal state and in a forwardly extended state, respectively.

Since the illustrated shelf is constructed as described above, the shelf plate support member (3) is mounted on the shelf strut (1) by engaging the engaging piece (5) of the shelf plate support member (3) with desired engaging holes (2) in the shelf strut (1). In the normal state, the shelf plate (10) is placed across the adjacent shelf plate support members (3) in such a manner that a reinforcement bent piece (13) along the front edge of the shelf plate (10) may ride on the tip ends of the shelf plate support horizontal flanges (6) and the rear surface of the shelf plate (10) may approach to the shelf struts (1). (See FIGS. 2, 3 and 6.)

Figure 1:
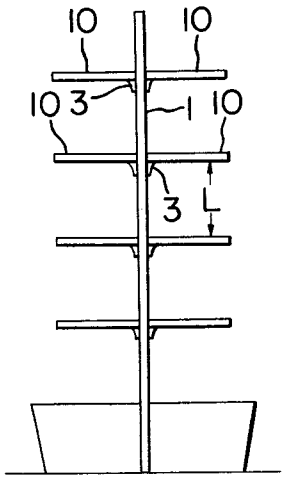
FIG. 1 is a side view of one preferred embodiment of the goods showcase according to the present invention.

In this state, since the horizontal section (4*a*) of the laterally long L-shaped vertical side plate (4) in the shelf plate support member (3) extends horizontally over a length of ⅔ or more of the overall length of the shelf plate support member (3) and the vertical section (4*b*) extends from the rear end of the horizontal section (4*a*), a large space having a sufficiently large shelf interval L over a length of ⅔ or more of the shelf depth is formed between vertically adjacent shelf plate support members (3) as will be obvious from FIG. 1. Therefore, goods can be smoothly placed on or taken out of the shelf plates (10) sideways of the shelves without being obstructed by the vertical sections (4*b*).

Figure 4:
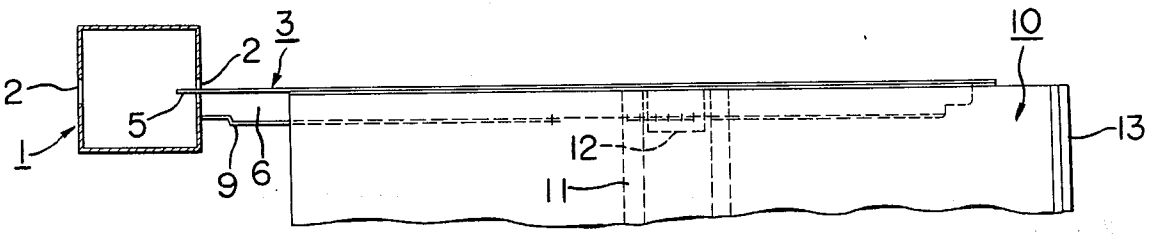
FIGS. 4 and 5 are a partial plan view and a longitudinal cross-section side view, respectively, showing the goods showcase according to the present invention in a forwardly extended state.
Figure 5:
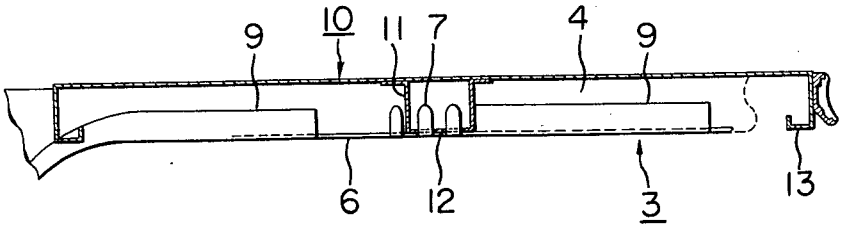
Figure 7:
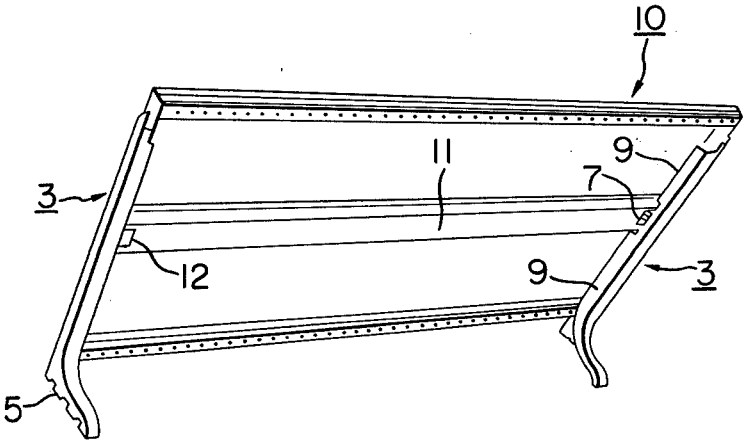

Subsequently, when it is necessary to increase the amount of goods to be displayed on the shelf plate (10), the shelf plate (10) may be pulled out forwardly along the upper surfaces of the shelf plate support horizontal flanges (6) of the associated shelf plate support members (3) and also the engaging claws (7) of the shelf plate support members (3) are engaged with the notches (12) of the reinforcement crosspiece (11), whereby the shelf plate (10) is firmly supported on the shelf plate support member (3) in the forwardly extended state. (See FIGS. 4, 5 and 7. )

Figure 3:
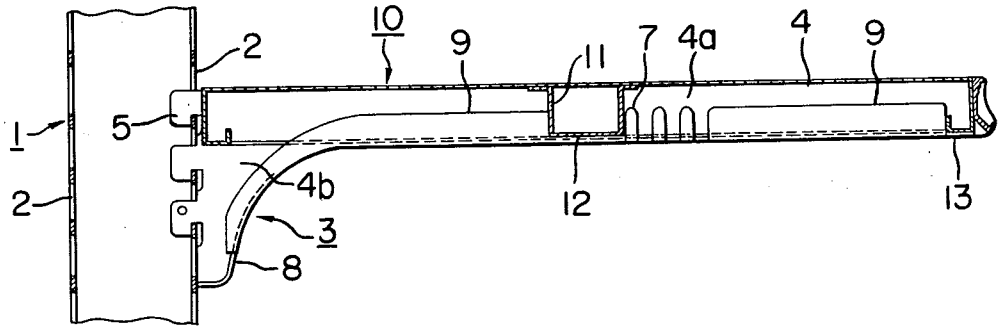

In the above-mentioned state, by placing the innermost goods (A) on the shelf plate (10) while projecting backwardly from the rear edge of the shelf plate (10) as shown in FIG. 2, the amount of the goods (A) displayed on the shelf plate (10) can be increased.

Figure 8:
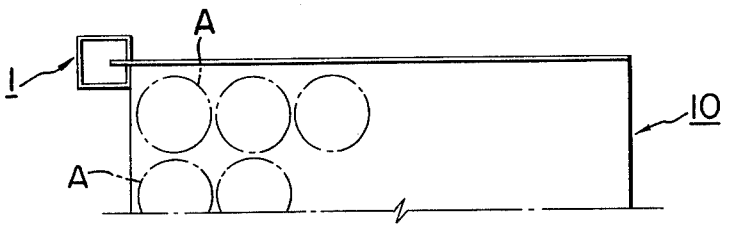
FIGS. 8 to 11 are partial plan views showing different positional relationships between a shelf plate and a shelf plate support member.
Figure 9:
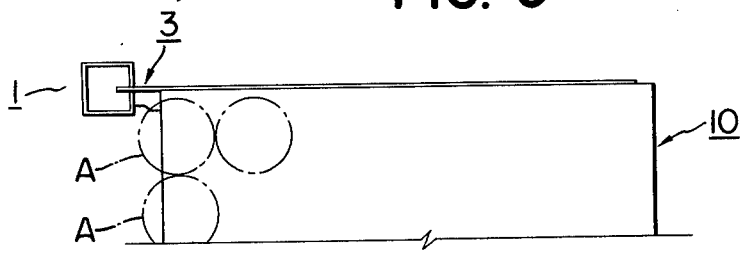
Figure 10:
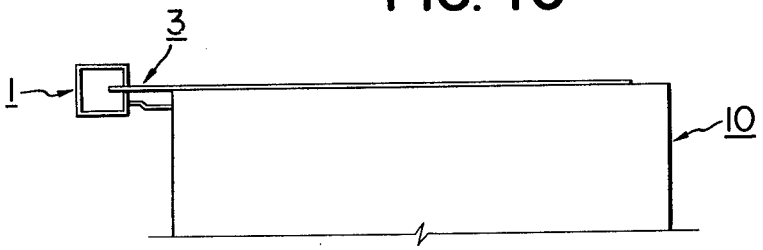
Figure 11:
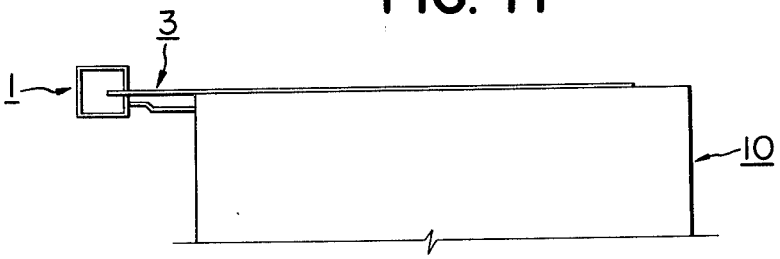
Figure 12:
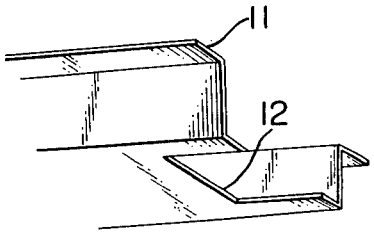
FIGS. 12 to 14 are perspective views showing different embodiments of an engaging section of a reinforcement crosspiece on a shelf plate.

In this case, since the aforementioned plurality of engaging claws (7) are disposed at predetermined intervals as projecting from the free edge of the shelf plate support horizontal flange (6) in the shelf plate support member (3), by appropriately selecting the engaging claws (7) to engage the notch (12) of the reinforcement crosspiece (11) on the shelf plate (10), the length of the forward extension of the shelf plate (10) can be adjusted as shown in FIGS. 9 to 11 starting from the normal state shown in FIG. 8 in accordance with the kind and size of the goods (A).

Figure 13:
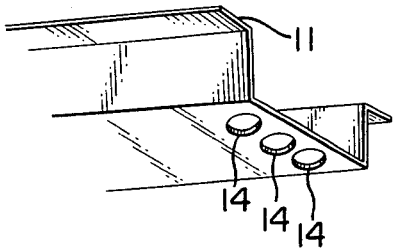
Figure 14:
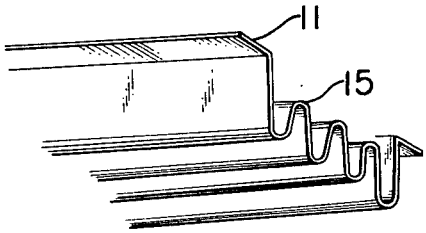

It is to be noted that the engaging section provided in the reinforcement crosspiece (11) on the shelf plate (10) which engages the engaging claws (7) could be composed of a plurality of holes (14) adapted to engage and disengage the engaging claws (7) as shown in FIG. 13, or else the end portion of the reinforcement crosspiece (11) could be shaped into a corrugated section (15) and be adapted to engage and disengage the engaging claws (7) as shown in FIG. 14.

As described above, according to the present invention it is possible to extend the shelf plates forwardly and also adjust the length of the extension for increasing the amount of various goods to be displayed, and further, it is possible to easily achieve loading and unloading of the goods on the shelf plates sideways of the shelves.

While the present invention has been described above in connection to its preferred embodiments, it is a matter of course that the invention should not be limited to only such embodiments but various changes in design could be made without departing from the spirit of the invention.

What is claimed is:

1. A goods showcase comprising:

a plurality of adjacent, vertical shelf struts, each strut having a plurality of engaging holes aligned in columular form;

shelf support members fitted into said engaging holes, each support member being comprised of:

an L-shaped side plate having a vertical portion and a horizontal portion extending away from said vertical portion, engaging members on the side of said vertical portion opposite said horizontal portion, said engaging members fitting into said engaging holes in said shelf struts, a horizontal flange extending at right angles from the lower edge of said side plate, and vertical engaging claws along the length of and extending upward from said horizontal flange; and at least one shelf plate positioned across said shelf support members on adjacent shelf struts, said shelf plate having a reinforcing plate on the underside thereof and said reinforcing plate being selectively engagable with said vertical engaging claws on said horizontal flange, whereby the horizontal distance from said shelf struts of said shelf plate on said shelf support member is varied by selecting the appropriate vertical engaging claws to be engaged by said reinforcing plate.

2. A showcase as claimed in claim 1, wherein said reinforcing plate on the underside of said shelf plate has notches in the underside thereof which are engagable with said engaging claws.

3. A showcase as claimed in claim 1, wherein said reinforcing plate has aligned holes on the underside thereof which are engagable with said engaging claws.

4. A showcase as claimed in claim 1, wherein said reinforcing plate is corrugated, and said corrugations are engagable with said engaging claws.

* * * * *